US012318008B2

(12) United States Patent
Thoreson et al.

(10) Patent No.: US 12,318,008 B2
(45) Date of Patent: Jun. 3, 2025

(54) CONVERTIBLE THEATER SEATING ASSEMBLY

(71) Applicant: Winnebago Industries, Inc., Eden Prairie, MN (US)

(72) Inventors: Brian Thoreson, Forest City, IA (US); Maciej Jaworski, Wysoka (PL); Klaus Hjort-Knudsen, Tarm (DK)

(73) Assignee: Winnebago Industries, Inc., Eden Prairie, MN (US)

( * ) Notice: Subject to any disclaimer, the term of this patent is extended or adjusted under 35 U.S.C. 154(b) by 228 days.

(21) Appl. No.: 17/712,159

(22) Filed: Apr. 3, 2022

(65) Prior Publication Data

US 2023/0232994 A1 Jul. 27, 2023

Related U.S. Application Data

(60) Provisional application No. 63/301,548, filed on Jan. 21, 2022.

(51) Int. Cl.
*A47C 17/16* (2006.01)
*A47C 17/175* (2006.01)

(52) U.S. Cl.
CPC ..... *A47C 17/1756* (2013.01); *A47C 17/162* (2013.01); *A47C 17/163* (2013.01)

(58) Field of Classification Search
CPC ..... A47C 17/16; A47C 17/161; A47C 17/162; A47C 17/163; A47C 17/165; A47C 17/1756; A47C 17/1655
See application file for complete search history.

(56) References Cited

U.S. PATENT DOCUMENTS 1,257,542 A * 2/1918 Singer ..... A47C 17/165 5/53.3
1,609,746 A * 12/1926 Vittone ..... A47C 17/40 5/53.3
3,048,855 A * 8/1962 Frank ..... A47C 17/165 297/124
3,872,523 A * 3/1975 Garza ..... A47C 17/165 5/12.1
4,669,135 A 6/1987 Gonzalez
5,064,244 A * 11/1991 Sproule ..... A47C 15/002 297/DIG. 7
5,104,182 A * 4/1992 Rasnick ..... A47C 7/543 297/188.14
5,136,737 A * 8/1992 Reppas ..... A47C 17/04 5/162
5,234,253 A * 8/1993 LaPointe ..... A47C 1/035 248/501
5,271,109 A 12/1993 Markel et al.
5,303,976 A * 4/1994 Nobile ..... A47C 17/02 297/146
5,374,108 A * 12/1994 Saul ..... A47C 7/70 297/378.1

(Continued)

*Primary Examiner* — Justin C Mikowski
*Assistant Examiner* — Ifeolu A Adeboyejo
(74) *Attorney, Agent, or Firm* — Faegre Drinker Biddle & Reath LLP

(57) ABSTRACT

A seat assembly includes independently rotatable and reclinable seats. The seats have back support sections that can be rotated between a sofa position and a compact position as well as the sofa position and a reclined position. The seats can further include leg rests that are movable between a lowered position and a raised position.

19 Claims, 10 Drawing Sheets

(56) References Cited

U.S. PATENT DOCUMENTS

| | | | | |
|---|---|---|---|---|
| 5,474,359 | A * | 12/1995 | Muffi | A47C 17/163 5/41 |
| 5,524,959 | A * | 6/1996 | Scott | A47C 7/70 297/125 |
| 10,939,770 | B2 | 3/2021 | Lopez Gil | |
| 2007/0040419 | A1* | 2/2007 | LaPointe | A47C 1/0345 297/69 |
| 2011/0248544 | A1* | 10/2011 | Adams | A47C 1/0355 297/423.19 |
| 2011/0314600 | A1 | 12/2011 | Baldassarra | |
| 2012/0131745 | A1* | 5/2012 | Wieland | A47C 17/62 5/2.1 |
| 2016/0270537 | A1* | 9/2016 | Marshall | A47C 1/0355 |
| 2020/0164778 | A1 | 5/2020 | Slater | |
| 2020/0170415 | A1* | 6/2020 | Broussard | A47C 17/165 |
| 2020/0305612 | A1* | 10/2020 | Dimitrov | A47C 17/38 |
| 2020/0367658 | A1* | 11/2020 | Cohen | A47C 17/38 |
| 2022/0133047 | A1* | 5/2022 | Chen | A47C 7/30 297/440.22 |

* cited by examiner

50

CONVERTIBLE THEATER SEATING ASSEMBLY

CROSS-REFERENCE TO RELATED APPLICATION

This application claims priority to Provisional Application No. 63/301,548, filed Jan. 21, 2022, which is herein incorporated by reference in its entirety.

SUMMARY

A seat assembly includes independently rotatable and reclinable seats. The seats have back support sections that can be rotated between a sofa position and a compact position as well as the sofa position and a reclined position. The seats can further include leg rests that are movable between a lowered position and a raised position.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
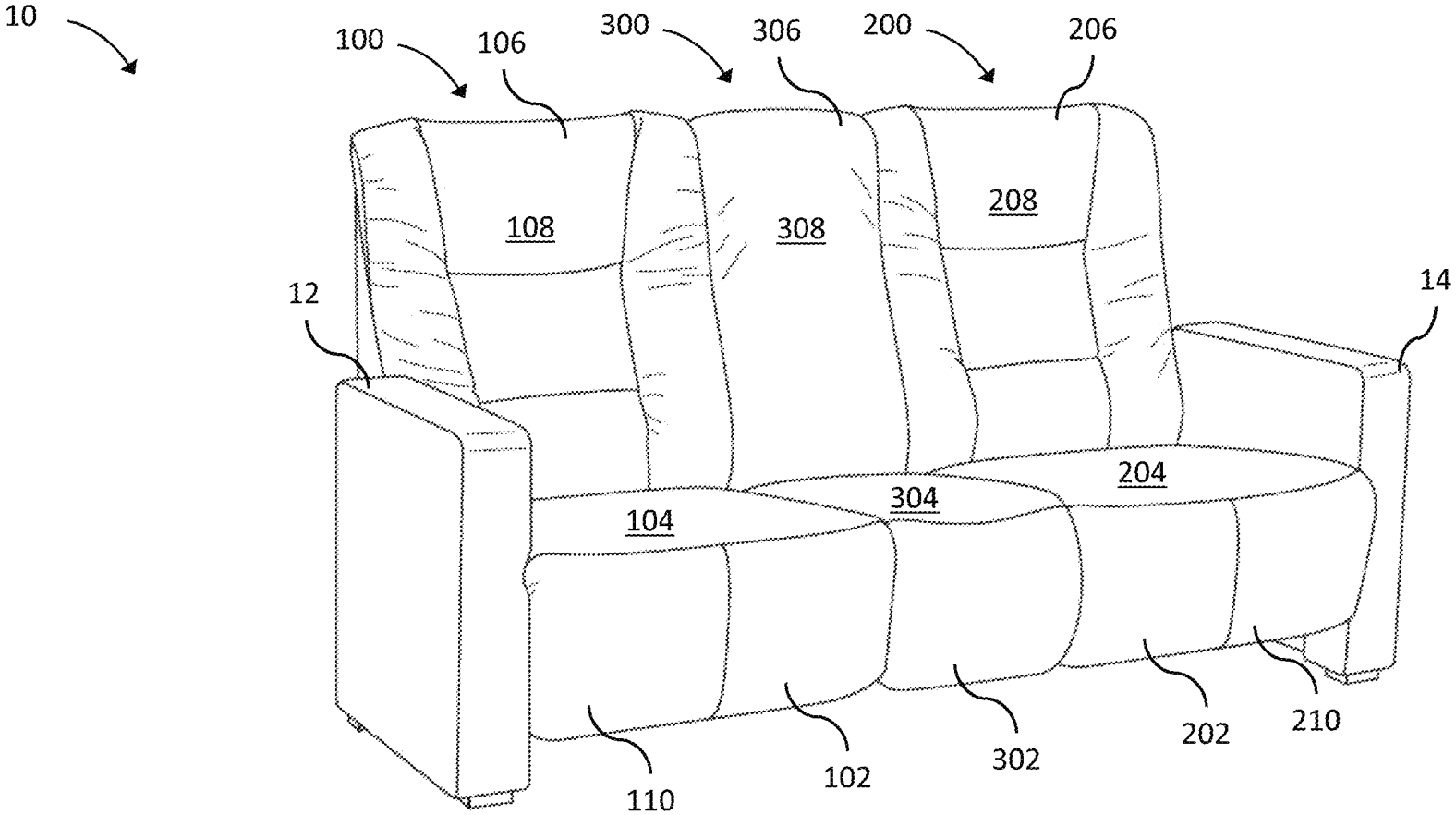
FIGS. 1-4 show various views and configurations of a convertible theater seating assembly, in accordance with certain embodiments of the present disclosure.

While the disclosure is amenable to various modifications and alternative forms, specific embodiments have been shown by way of example in the drawings and are described in detail below. The intention, however, is not to limit the disclosure to the particular embodiments described but instead is intended to cover all modifications, equivalents, and alternatives falling within the scope the appended claims.

DETAILED DESCRIPTION

FIG. 1 shows a convertible theater seating assembly 10 (hereinafter "the seating assembly 10" for brevity). As will be described in more detail below, the seating assembly 10 is able to convert between several positions, and individual sections of the seating assembly 10 are able to be moved independently of each other. This versatility allows the seating assembly 10 to be used in a variety of applications, including those with space constraints.

As shown in FIG. 1, the seating assembly 10 includes a first arm rest support 12 and a second arm rest support 14. The seating assembly 10 also includes a first seat 100, a second seat 200, and a third seat 300 positioned between the first arm rest support 12 and the second arm rest support 14. The third seat 300 is positioned between the first seat 100 and the second seat 200. Throughout this description, parts or sections of the first seat 100 will be associated with reference numbers in the 100*s*, parts or sections of the second seat 200 will be associated with reference numbers in the 200*s*, and parts or sections of the third seat 300 will be associated with reference numbers in the 300*s*. As will be described in more detail below, the first seat 100, second seat 200, and third seat 300 are able to be independently configurable or movable with respect to each other such that each seat can be positioned in different configurations at any given time.

The first seat 100 includes a first base support 102 with a top seating surface 104. The first seat 100 also includes a first back support 106 with a first back support surface 108. Further, the first seat 100 includes a first leg rest 110.

The second seat 200 includes a second base support 202 with a second top seating surface 204. The second seat 200 also includes a second back support 206 with a second back support surface 208. Further, the second seat 200 includes a second leg rest 210.

The third seat 300 includes a third base support 302 with a third top seating surface 304. The third seat 300 also includes a third back support 306 with a third back support surface 308.

The first seat 100, second seat 200, and third seat 300 can be upholstered such that they are separately filled with a stuffing material and covered by materials like cloth, leather, etc. to create the various surfaces mentioned above.

Figure 2:
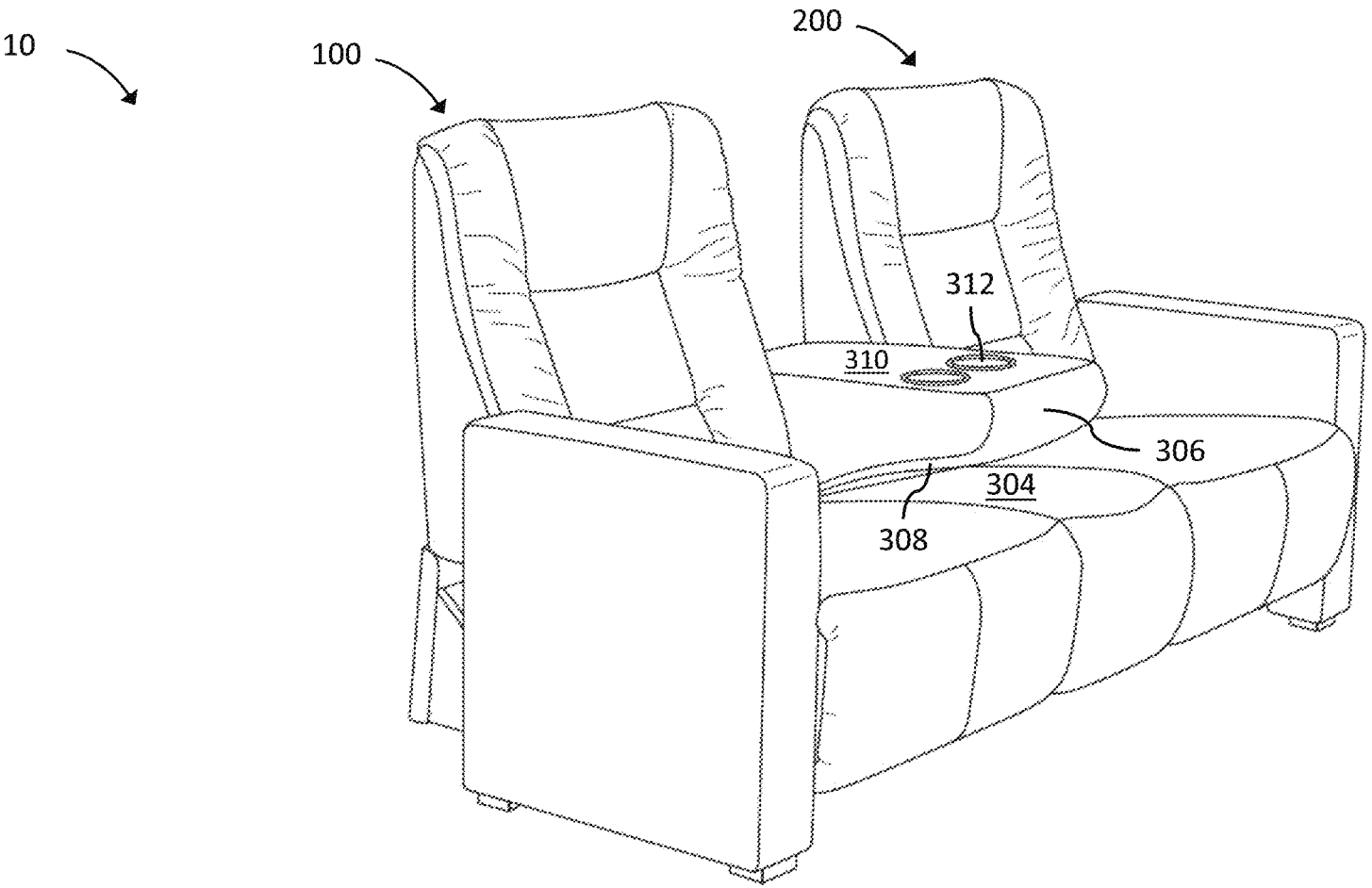

In FIG. 2, the third back support 306 has been moved from its sofa position (shown in FIG. 1) to a compact position (or lowered position). In the compact position, the third back support 306 has been rotated approximately 90 degrees—compared to its orientation in the sofa position—such that the third back support surface 308 faces the third top seating surface 304. In this position, users sitting in the first seat 100 and the second seat 200 can use the third back support 306 as an arm rest. Further, as shown in FIG. 2, the third back support 306 can include a cupholder 310. For example, the third back support 306 can include a rear surface 312 that defines openings for holding a cup or bottle, for example. Other than the cupholders 310, the rear surface 312 can be substantially flat.

Figure 3:
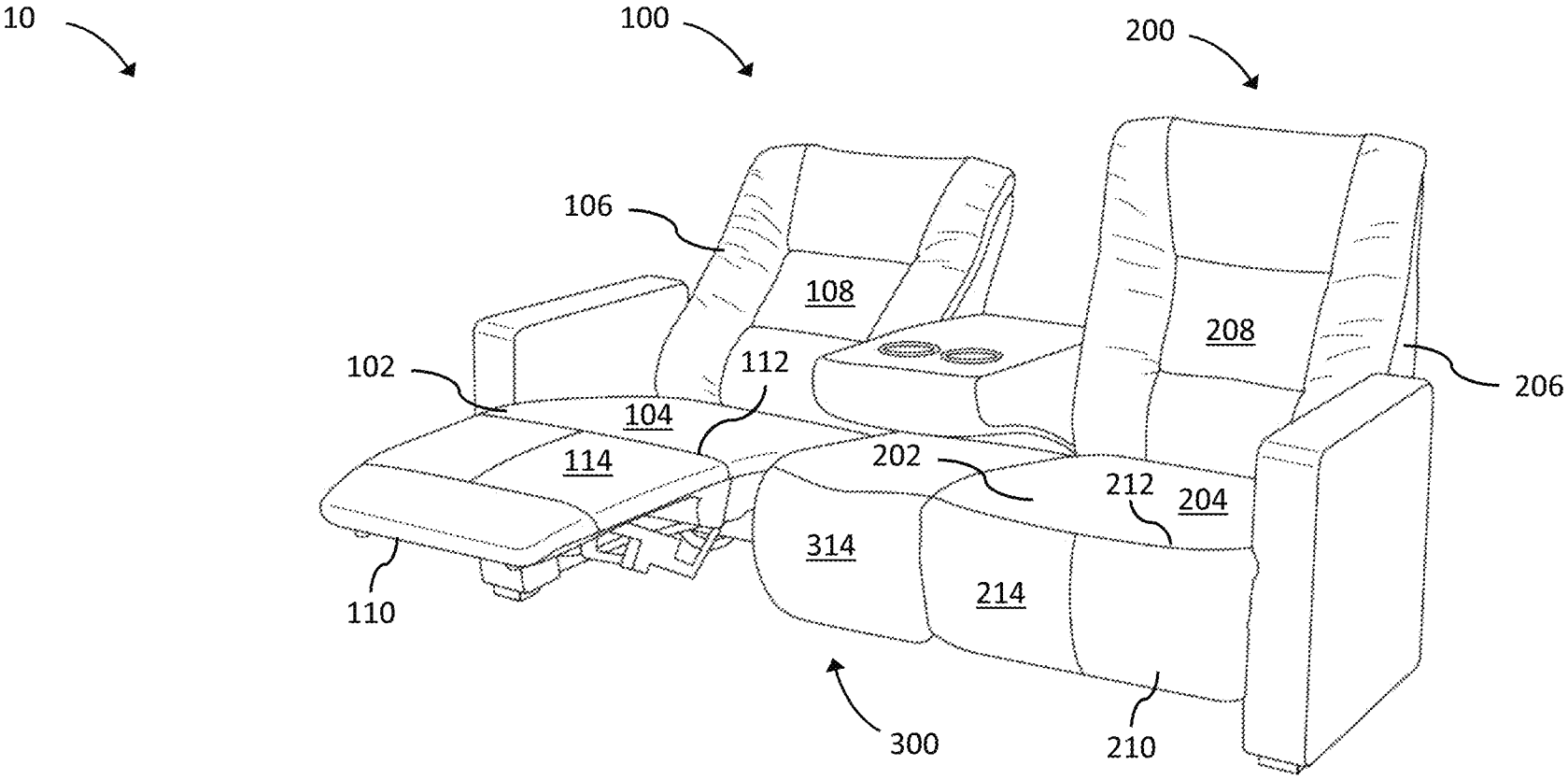

FIG. 3 shows the same position as that shown in FIG. 2 except that the first seat 100 has been moved from its sofa position to a reclined position.

In the reclined position, the first back support 106 is moved to lean back. For example, the first back support surface 108 of the first back support 106 may be rotated—compared to its orientation in the sofa position—between 30 and 45 degrees such that a user's back can be supported in a reclined or laid-back position.

Also, as the first seat 100 is moved between the sofa position to the reclined position, the first base support 102 is moved forward and tilted. For example, a front boundary 112 of the top seating surface 104 is moved forward past a front lower surface 314 of the third seat 300. The front boundary 112 can be the outer boundary of the top seating surface 104 along the interface between the top seating surface 104 and the first leg rest 110.

In the reclined position, the first leg rest 110 is moved from its lowered position (shown in FIGS. 1 and 2) to its raised position (shown in FIG. 3). In the compact position, the first leg rest 110 has been rotated 90 degrees or less (e.g., 75-85 degrees)—compared to its orientation in the lowered position—such that a front surface 114 of the first leg rest 110 is nearly parallel to the floor on which the seating assembly 10 rests. As such, when the first seat 100 is moved from its sofa position to reclined position, the first base support 102 and the first back support 106 move between their respective positions.

Like the first seat 100, the second seat 200 can been moved from its sofa position to a reclined position. In the reclined position, the second back support 206 is moved to lean back. For example, the second back support surface 208 of the second back support 206 may be rotated—compared to its orientation in the sofa position— between 30 and 45 degrees such that a user's back can be supported in a reclined or laid-back position.

Also, as the second seat 200 is moved between the sofa position to the reclined position, the second base support 202 is moved forward and tilted. For example, a front boundary 212 of the top seating surface 204 is moved forward past the front lower surface 314 of the third seat 300. The front boundary 212 can be the outer boundary of the top seating surface 204 along the interface between the top seating surface 204 and the second leg rest 210.

In the reclined position, the second leg rest 210 is moved from its lowered position (shown in FIGS. 1 and 2) to its raised position (shown in FIG. 3). In the compact position, the second leg rest 210 has been rotated approximately 90 degrees or less—compared to its orientation in the lowered position—such that a front surface 214 of the second leg rest 210 is nearly parallel to the floor on which the seating assembly 10 rests. As such, when the second seat 200 is moved from its sofa position to reclined position, the second base support 202 and the second back support 206 move between their respective positions.

Figure 4:
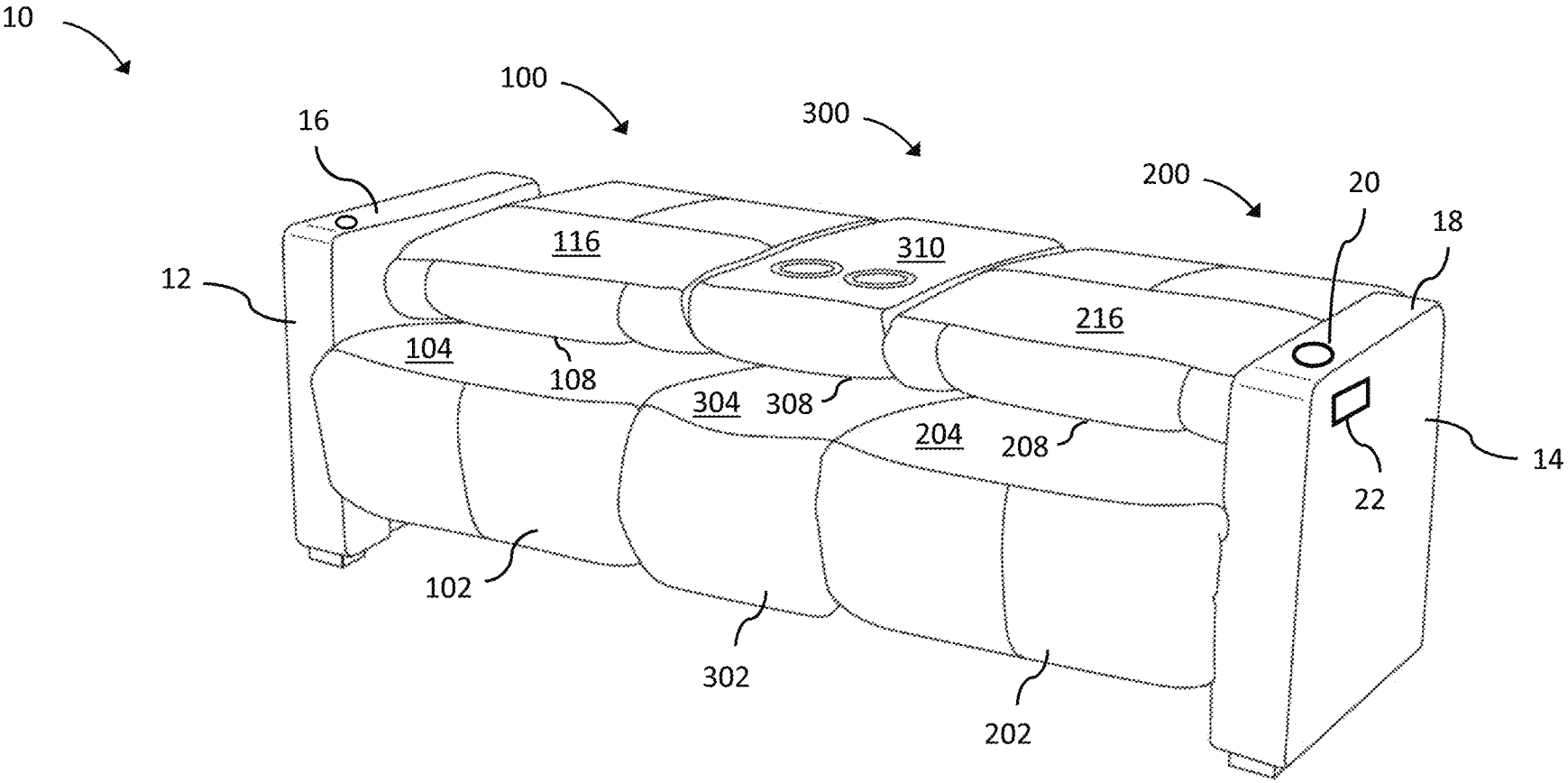

FIG. 4 shows the seating assembly 10 with the first seat 100, second seat 200, and third seat 300 all positioned in their respective compact positions (or lowered positions) as opposed to their respective sofa positions (as shown in FIG. 1). In the compact positions, the first back support 106, second back support 206, and third back support 306 have each been rotated approximately 90 degrees—compared to their orientations in the sofa position—such that their respective back support surfaces 108, 208, and 308 face respective top seating surfaces 104, 204, and 304. In certain embodiments, the respective back support surfaces 108, 208, and 308 are approximately parallel to respective top seating surfaces 104, 204, and 304. Further, in certain embodiments, the respective back support surfaces 108, 208, and 308 directly contact respective top seating surfaces 104, 204, and 304.

As shown in FIG. 4, when the first seat 100, second seat 200, and third seat 300 are all positioned in their compact positions, each of the seats is positioned lower than top surfaces 16, 18 (e.g., uppermost surfaces) of the first arm rest support 12 and the second arm rest support 14. In certain embodiments, in the compact positions, the first back support 108, second back support 208, and third back support 308 are completely positioned between the top surfaces 16, 18 of the first arm rest support 12 and the second arm rest support 14 and one or both of (1) the base supports 102, 202, and 302 and (2) the top seating surfaces 104, 204, and 304.

Also, in the compact positions, respective rear surfaces 116, 216, and 310 of the seats are all positioned lower than the top surfaces 16, 18 of the first arm rest support 12 and the second arm rest support 14. These rear surfaces 116, 216, and 310 are essentially flat and extend parallel to: (1) respective back support surfaces 108, 208, and 308, (2) respective top seating surfaces 104, 204, and 304, and/or (3) the floor on which the seating assembly 10 rests. In certain embodiments, rear surfaces 116, 216, and 310 comprise a material that is different than the top seating surfaces 104, 204, and 304 and/or the back support surfaces 108, 208, and 308. For example, the rear surfaces 116, 216, and 310 can comprise a material such that the rear surfaces have a lower coefficient of friction than the seating and support surfaces. The rear surfaces 116, 216, and 310 can comprise a suede material while the other surfaces can comprise a leather or synthetic leather, as one set of examples. As will be described in more detail below, the lower friction rear surfaces help permit a bed to slide along the rear surfaces when the bed and the seating assembly 10 are converted to a sleeping position. Further, the material of the rear surfaces 116, 216, and 310 helps protect against wear if the rear surfaces contact a wall or other structure in the sofa position.

In certain embodiments, the first base support 102, second base support, 202, and third base support 302 remain stationary while the first back support 106, second back support 206, and third back support 306 are rotated between their sofa positions and compact positions. Put another way, the first back support 106, second back support 206, and third back support 306 are rotatable independent of the first back support 106, second back support 206, and third back support 306. And, the first back support 106, second back support 206, and third back support 306 are rotatable independent of each other.

The seating assembly 10 can include one or more structures 20 protruding from the first arm rest support 12 and the second arm rest support 14. These structures 20 can provide support for a table to rest above the first back support 106, second back support 206, and third back support 306 when the back supports are in the compact position. The seating assembly 10 can also include an outlet 22 on one or both of the first arm rest support 12 and the second arm rest support 14. The outlet 22 can include one or more power outlets (e.g., USB connectors) to which cables (e.g., charging cables) can be connected to.

Figure 5:
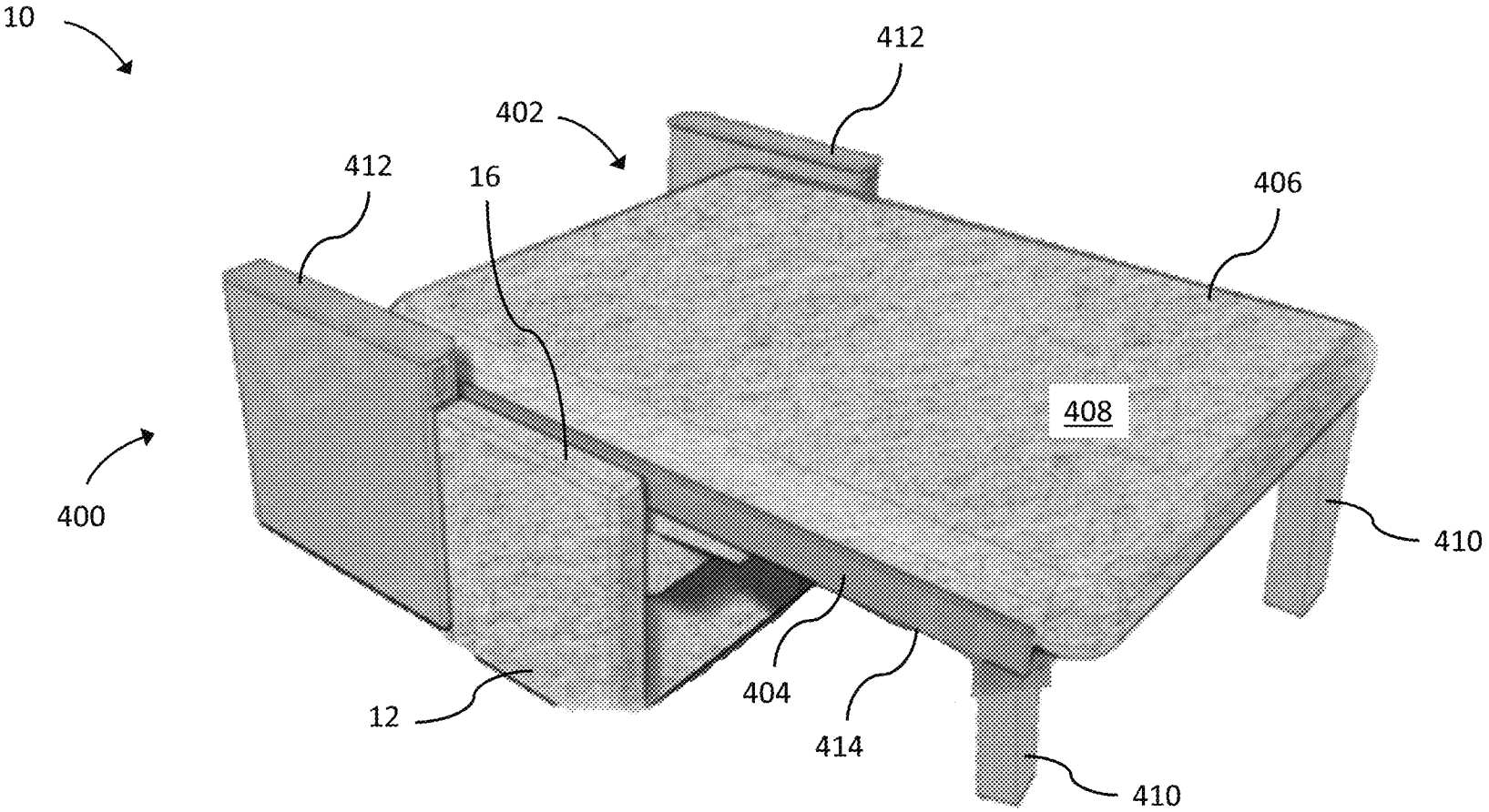
FIG. 5 shows the convertible theater seating assembly of FIGS. 1-4 and a murphy bed, in accordance with certain embodiments of the present disclosure.

FIG. 5 shows the seating assembly 10 and a bed assembly 400. In certain embodiments, the bed assembly 400 includes a bed 402 (e.g., wall bed, pull-down bed, fold-down bed, Murphy bed) that is movable between a stored position and a use position (or sleeping position).

The bed 402 includes a platform 404 that supports a mattress 406. For example, the mattress 406 can rest on a top surface of the platform 404. In the stored position, the bed 402 is oriented vertically against the wall or inside a closet or cabinet. For example, in the stored position, the entire bed assembly 400 (including the bed 402) can be positioned behind the seating assembly 10, such as between a wall (e.g., a wall of a recreational vehicle) and the seating assembly 10.

In the use position (shown in FIG. 5), the bed 402 has been rotated approximately 90 degrees compared to its orientation in the stored position such that a top surface of the platform 404 and/or a top surface 408 of the mattress is substantially parallel with the floor.

On one end, the bed 402 can include legs 410 that extend between the platform 404 and the floor to support the platform 404. On the other end, the bed 402 can be rotatably coupled (e.g., via one or more hinges) to supports 412.

As noted above, the seating assembly 10 allows for the first back support 106, second back support 206, and third back support 306 to be rotated between their sofa positions and compact positions. In FIG. 5, the back supports 106, 206, and 306 are shown in their compact positions (laying face-down). As a result, the bed 402 can be rotated to its use position and extend directly above and over the seating assembly 10. In this position, the rear surfaces 116, 216, and 310 of the back supports 106, 206, and 306 face a bottom surface 414 of the platform 404. In certain embodiments, the rear surfaces 116, 216, and 310 directly contact the bottom surface 414 of the platform 404. As noted above, because the rear surfaces 116, 216, and 310 comprise a lower friction material, the bottom surface 414 of the platform 404 can more easily slide along the rear surfaces as the bed 402 and the seating assembly 10 are converted to the use position. In certain embodiments, the rear surfaces 116, 216, and 310 have a lower coefficient of friction compared to the bottom surface 414 of the platform 404.

As shown in FIG. 5, the bed 402 can be positioned directly between the first arm rest support 12 and the second arm rest support 14. In certain embodiments, a portion of the bed 402 can be positioned below the top surfaces 16, 18 of the first arm rest support 12 and the second arm rest support 14 and another portion of the bed 402 can be positioned above the top surface 16, 18.

The versatility of the seating assembly 10 allows the bed assembly 400 to be positioned immediately behind the seating assembly 10 and still permit a wall bed, pull-down bed, etc. to be used.

Internal Frame

FIGS. 6 to 9 show various views and sections of an internal frame 50 of the seating assembly 10.

Figure 6:
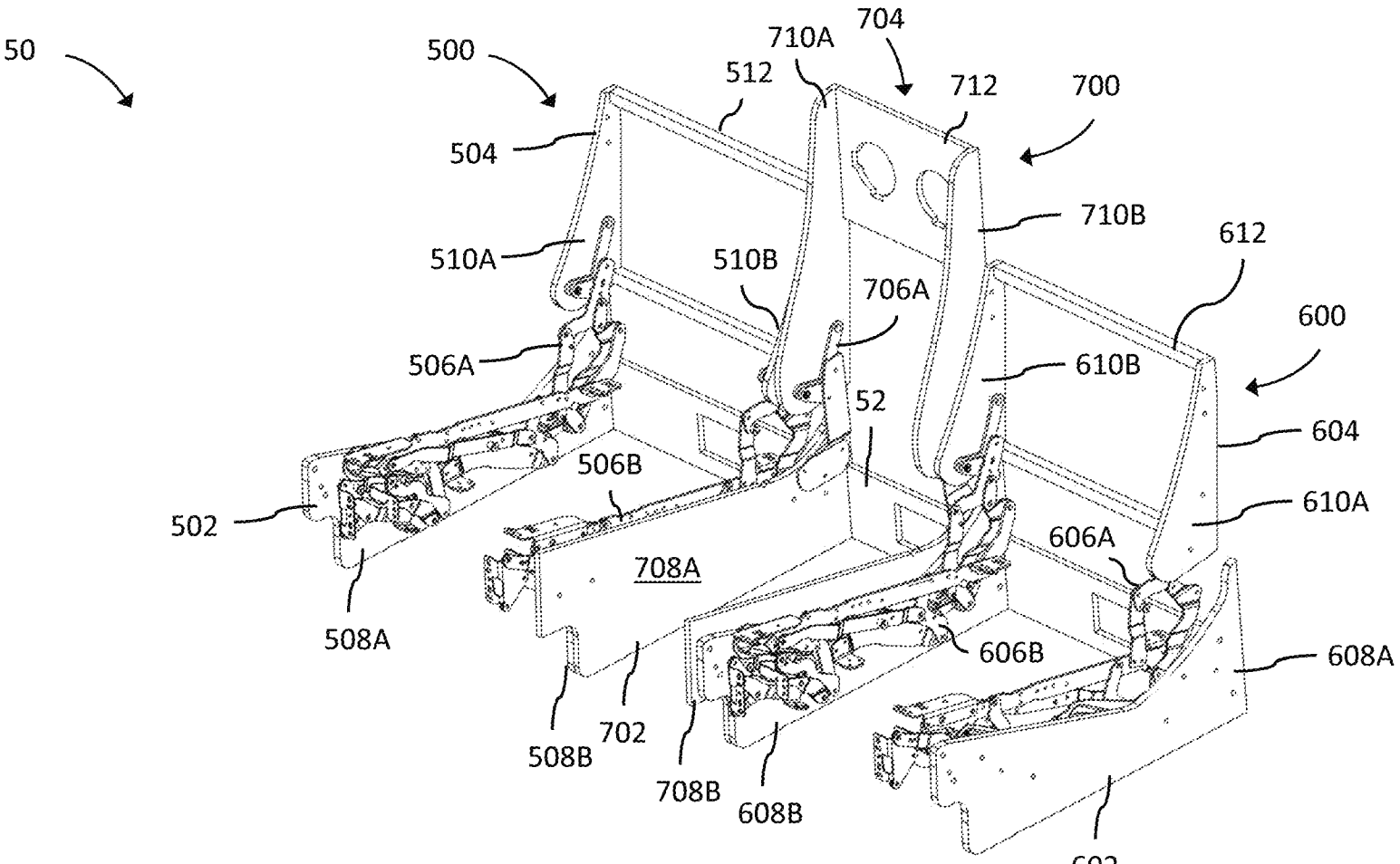
FIGS. 6-12 show various views of an internal frame for the convertible seating assembly of FIGS. 1-4, in accordance with certain embodiments of the present disclosure.

As shown in FIG. 6, the internal frame 50 includes a first seat frame section 500, a second seat frame section 600, and a third seat frame section 700 positioned between the first seat frame section 500 and the second seat frame section 600. Throughout this description, parts of the first seat frame section 500 will be associated with reference numbers in the 500*s*, parts of the second seat frame section 600 will be associated with reference numbers in the 600*s*, and parts of the third seat frame section 700 will be associated with reference numbers in the 700*s*.

The first seat frame section 500 and the second seat frame section 600 mirror each other such that they have similar parts. The first seat frame section 500 is positioned internally to the first seat 100 of FIG. 1.

The first seat frame section 500 includes a first base support frame 502 that is coupled to a first back support frame 504 via first and second frame mechanisms 506A and 506B. As will be described in more detail below, the first and second frame mechanisms 506A and 506B are designed to allow the first seat frame section 500 (and therefore the first seat 100 of FIG. 1) to move between its various orientations/positions.

The first base support frame 502 includes two opposing lower side panels 508A and 508B. The lower side panels 508A and 508B (and other panels mentioned in this description) can comprises a wood-based material. Parts of the first frame mechanism 506A are directly coupled to the first lower side panel 508A. For example, one or more fasteners (e.g., screws, nails, staples) can secure the first frame mechanism 506A to the first lower side panel 508A (e.g., an inside-facing surface of the first lower side panel 508A). Similarly, parts of the second frame mechanism 506B are directly coupled to the second lower side panel 508B (e.g., an inside-facing surface of the second lower side panel 508B).

The first back support frame 504 includes two opposing upper side panels 510A and 510B. Parts of the first frame mechanism 506A are directly coupled to the first upper side panel 510A. For example, one or more fasteners can secure the first frame mechanism 506A to the first upper side panel 510A (e.g., an inside-facing surface of the first upper side panel 510A). Similarly, parts of the second frame mechanism 506B are directly coupled to the second upper side panel 510B (e.g., an inside-facing surface of the second upper side panel 510B). The first back support frame 504 can also include one or more cross-section structures 512 coupled between the two opposing upper side panels 510A and 510B.

The second seat frame section 600 is positioned internally to the second seat 200 of FIG. 1. The second seat frame section 600 includes a second base support frame 602 that is coupled to a second back support frame 604 via its own first and second frame mechanisms 606A and 606B. As will be described in more detail below, the first and second frame mechanisms 606A and 606B are designed to allow the second seat frame section 600 (and therefore the second seat 200 of FIG. 1) to move between its various orientations/positions.

The second base support frame 602 includes two opposing lower side panels 608A and 608B. Parts of the first frame mechanism 606A are directly coupled to the first lower side panel 608A (e.g., an inside-facing surface of the first lower side panel 608A). For example, one or more fasteners can secure the first frame mechanism 606A to the first lower side panel 608A. Similarly, parts of the second frame mechanism 606B are directly coupled to the second lower side panel 608B (e.g., an inside-facing surface of the second lower side panel 608B).

The second back support frame 604 includes two opposing upper side panels 610A and 610B. Parts of the first frame mechanism 606A are directly coupled to the first upper side panel 610A. For example, one or more fasteners can secure the first frame mechanism 606A to the first upper side panel 610A (e.g., an inside-facing surface of the first upper side panel 610A). Similarly, parts of the second frame mechanism 606B are directly coupled to the second upper side panel 610B (e.g., an inside-facing surface of the second upper side panel 610B). The second back support frame 604 can also include one or more cross-section structures 612 coupled between the two opposing upper side panels 610A and 610B.

The third seat frame section 700 is positioned internally to the third seat 300 of FIG. 1. The third seat frame section 700 includes a third base support frame 702 that is coupled to a third back support frame 704 via a first frame mechanism 706A and a second frame mechanism. The third base support frame 702 includes two opposing lower side panels 708A and 708B. Parts of the first frame mechanism 706A are directly coupled to the first lower side panel 708A. For example, one or more fasteners can secure the first frame mechanism 706A to the first lower side panel 708A (e.g., an inside-facing surface of the first lower side panel 708A). Similarly, parts of the second frame mechanism are directly coupled to the second lower side panel 708B (e.g., an inside-facing surface of the second lower side panel 708A). As shown in FIG. 6, the first lower side panel 708A can be directly coupled to the second lower side panel 508B of the first seat, and the second lower side panel 708B can be directly coupled to the second lower side panel 508B of the second seat.

The third back support frame 704 includes two opposing upper side panels 710A and 710B. Parts of the first frame mechanism 706A are directly coupled to the first upper side panel 710A. For example, one or more fasteners can secure the first frame mechanism 706A to the first upper side panel 710A (e.g., an inside-facing surface of the first upper side panel 710A). Similarly, parts of the second frame mechanism 706B are directly coupled to the second upper side panel 710B (e.g., an inside-facing surface of the second upper side panel 710B). The second back support frame 704 can also include one or more cross-section structures 712 coupled between the two opposing upper side panels 710A and 710B. In FIG. 6, the cross-section structure 712 includes openings for cup-holders.

In certain embodiments, the internal frame 50 includes a back support panel 52 that is coupled to each of the lower side panels 508A, 508B, 608A, 608B, 708A and 708B. In other embodiments, each of the seat frame sections 500, 600, and 700 include their own separate back support panel. In embodiments, the lower side panels 508A, 508B, 608A, 608B, 708A and 708B and the back support panel 52 remain stationary while the other parts of the internal frame 50 (and the seat assembly 10) are moved between their various orientations/positions.

Figure 7:
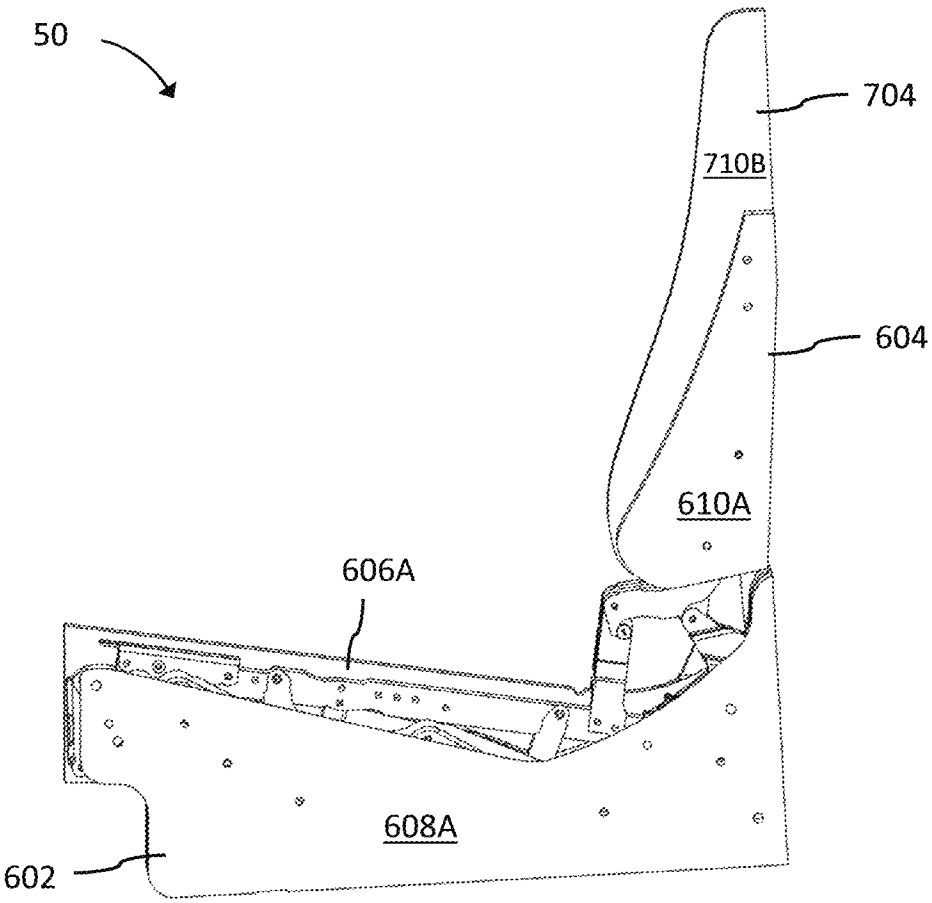

FIG. 7 shows a side view of the internal frame 50, including the second base support frame 602 (including the first lower side panel 608A), second back support frame 604 (including the first upper side panel 610A), second frame mechanism 606B, and the third back support frame 704 (including the second upper side panel 710B). In FIG. 7, the internal frame 50 is in the position it would be when the seats are positioned in their sofa positions (as opposed to their compact positions).

Figure 8:
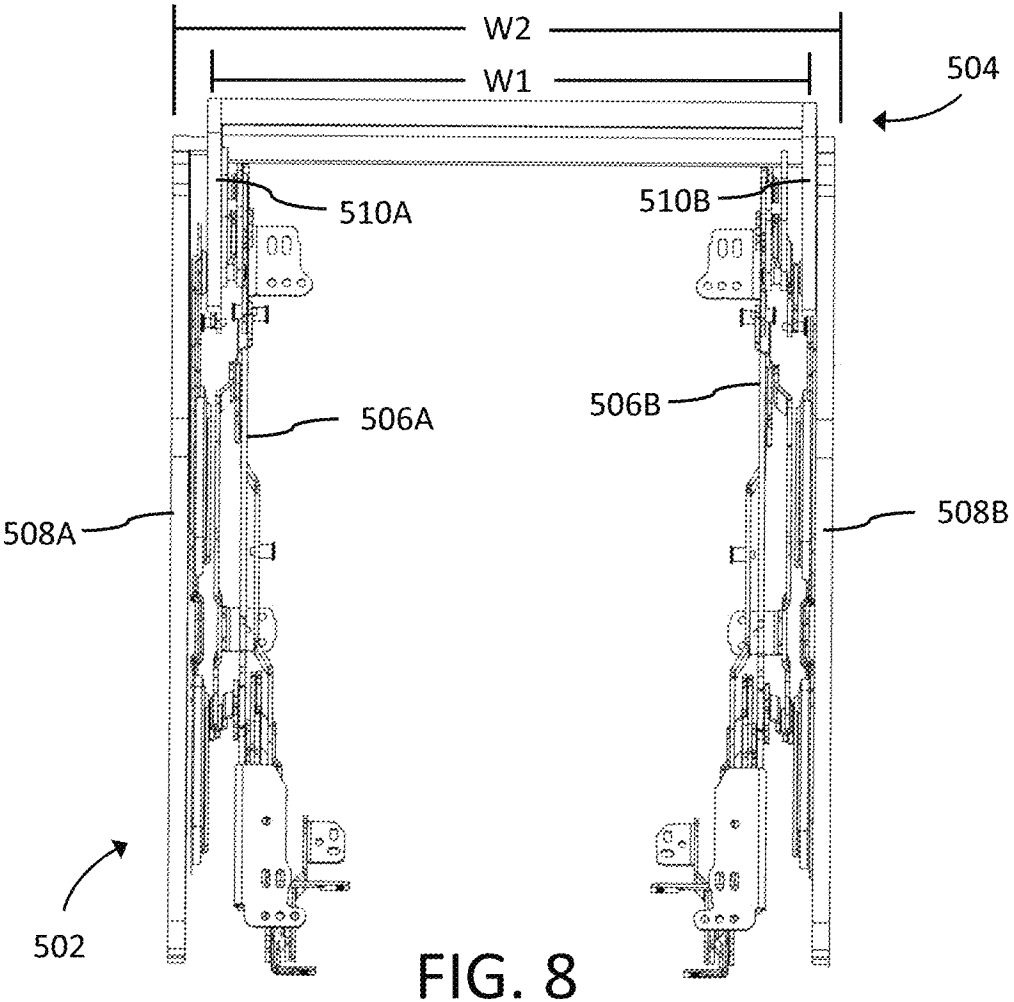

FIG. 8 shows a top view of a portion of the internal frame 50, including the first base support frame 502, first back support frame 504, and first and second frame mechanisms 506A and 506B. In FIG. 8, the internal frame 50 is in the position it would be when the first seat is positioned in its sofa position (as opposed to its compact position). Although only portions of the first seat frame section 500 are shown in FIG. 8, the second seat frame section 600 mirrors that of the first seat frame section 500.

FIG. 8 shows that the first back support frame 504 has an overall width (W1) that is less than the overall width (W2) of the first base support frame 502. As such, when the first seat in is the compact position, portions of the first back support frame 504 can be positioned directly between the first base support frame 502 (e.g., directly between the first and second lower side panels 508A and 508B). In certain embodiments, the cross-section structure(s) of the first back support frame 504 are shorter than the cross-section structure(s) of the first base support frame 502.

Figure 9:
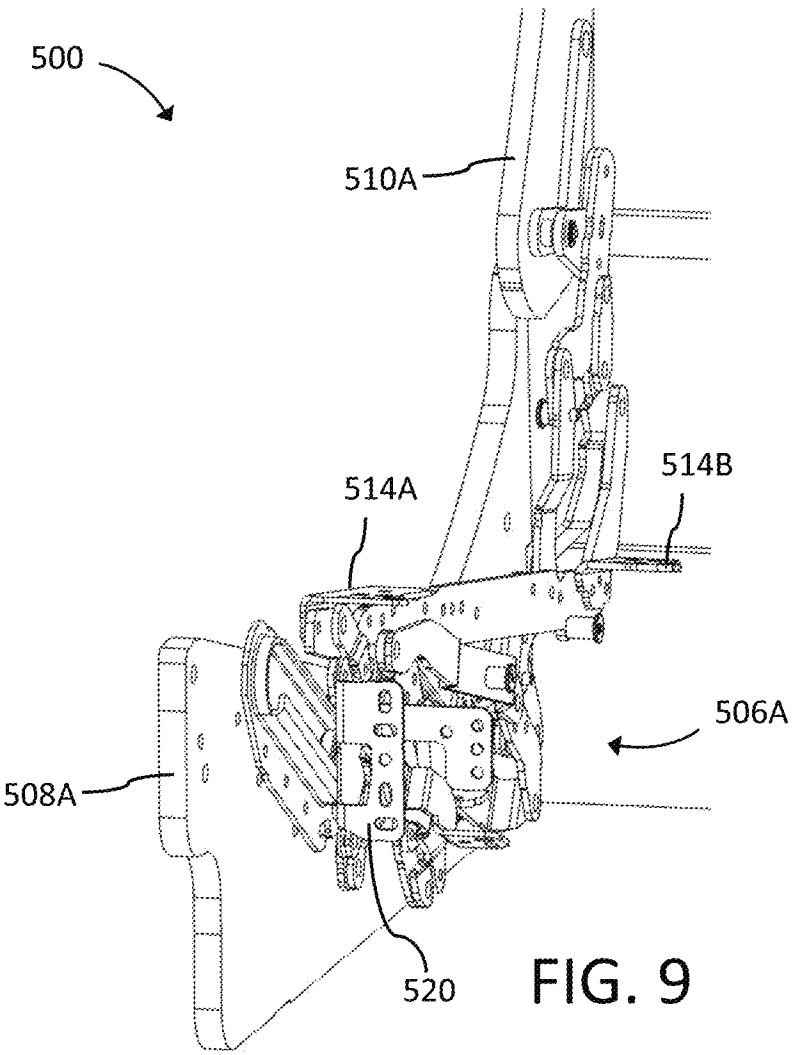

FIG. 9 shows a portion of the first seat frame section 500, including the and first frame mechanism 506A, first lower side panel 508A, and first upper side panel 510A. As shown in FIG. 9, the first frame mechanism 506A includes many frame members. The frame members (and other frame members mentioned in this description) can comprises a metallic material (as opposed to the wood materials described with respect to the panels).

One frame member includes or is coupled to base supports 514A and 514B. The base supports 514A and 514B couple to and support the first base support 102 (shown in FIG. 1). For example, the first base support 102 may include a lower panel on which stuffing, upholstery, etc., is assembled to. The lower panel can be fastened to the base supports 514A and 514B so that the lower panel is rigidly coupled to the first frame mechanism 506A. The lower panel can also be fastened to the second frame mechanism 506B. As such, when the first and second frame mechanisms 506A and 506B move between positions, the first base support 102 does too.

Figure 10:
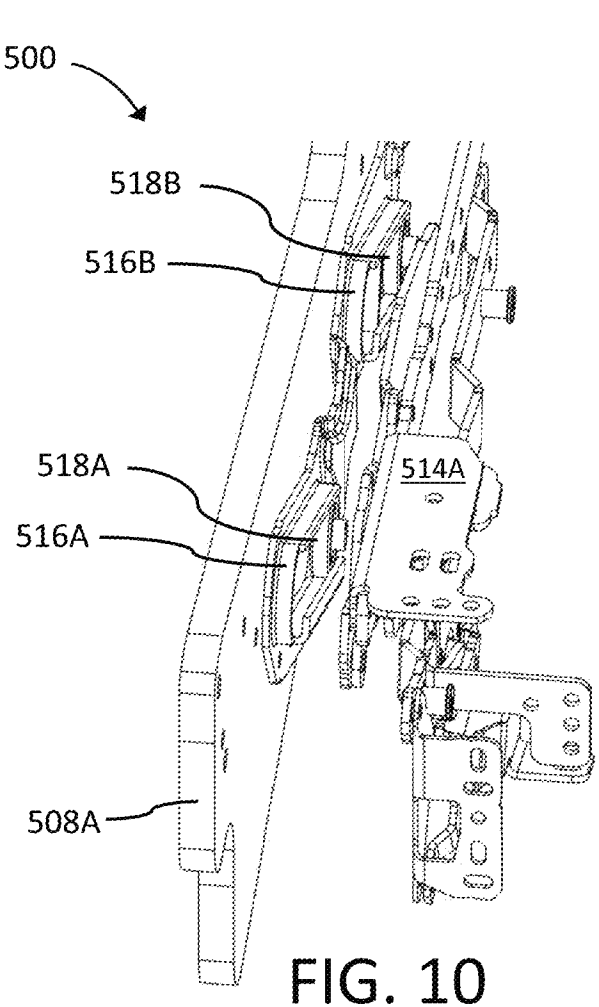

Moving briefly to FIG. 10, the first frame mechanism 506A includes a pair of slots 516A and 516B and a pair of bearings 518A and 518B. The pair of bearings 518A and 518B slide or rotate within respective slots 516A and 516B to move the first base support 102 between the sofa position and the reclined position. As the base support 102 moves from the sofa position to the reclined position, the first base support 514A moves forward and rises such that a front portion of the base support 102 also moves forward and rises. The second base support 514B also moves forward, however, will lower in the reclined position such that the base support 102 is tipped or oriented such that the front portion is higher relative to the back portion to provide a recline.

Moving back to FIG. 9, another frame member includes or is coupled to a leg rest support 520. The leg rest support 520 can be coupled to a rear panel of the first leg rest 110 (shown in FIG. 1). As the base support 102 is moved from the sofa position to the reclined position, the leg rest support 520 rotates between its lowered position to its raised position.

Figure 12:
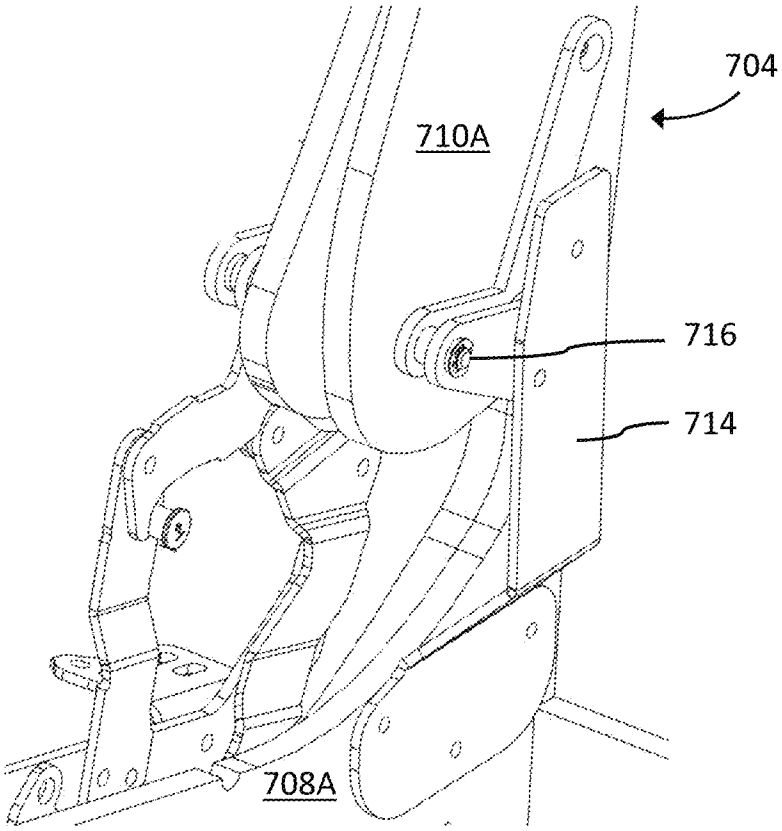
Figure 11:
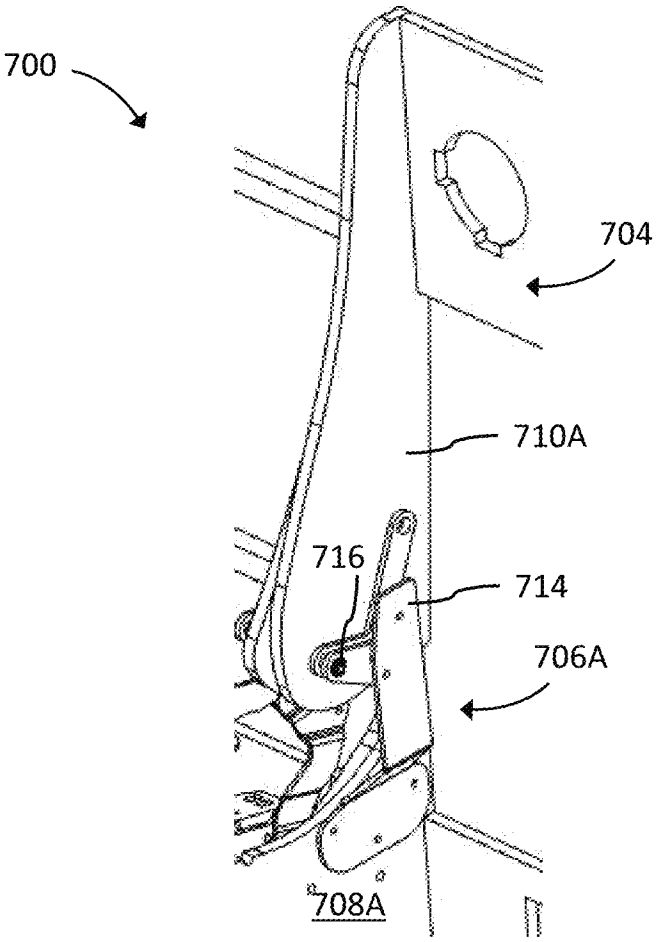

FIGS. 11 and 12 show different views of a portion of the third seat frame section 700, including the third back support frame 704. As shown, the first lower side panel 708A is coupled to the first upper side panel 710A by the first frame mechanism 706A. The first frame mechanism 706A includes various frame members (e.g., brackets) and a pivot 716. The pivot 716 allows the third back support frame 704 (and therefore the third back support 306 shown in FIG. 1) to rotate between the sofa position and the compact position. The second frame mechanism can mirror the first frame mechanism 706A.

Various modifications and additions can be made to the embodiments disclosed without departing from the scope of this disclosure. For example, while the embodiments described above refer to particular features, the scope of this disclosure also includes embodiments having different combinations of features and embodiments that do not include all of the described features. Accordingly, the scope of the present disclosure is intended to include all such alternatives, modifications, and variations as falling within the scope of the claims, together with all equivalents thereof.

We claim:

1. A seat assembly comprising:

a first seat including a first internal frame section, a first back support having a first rear surface and a first back support surface, and a first base support, wherein the first back support and the first base support are movable between a first sofa position and a first reclined position, wherein the first back support is also movable between the first sofa position and a first compact position, wherein the first base support includes a first base support frame with a first side panel;

a second seat including a second internal frame section, a second back support having a second rear surface and a second back support surface, and a second base support, wherein the second back support and the second base support are movable between a second sofa position and a second reclined position, wherein the second back support is also movable between the second sofa position and a second compact position; and a third seat including a third internal frame section, a third back support, and a third base support, wherein the first internal frame section includes a first frame mechanism that includes a first slot and a first bearing arranged to move within the first slot as the first base support is moved between the first sofa position and the first reclined position, wherein the first frame mechanism is directly coupled to the first side panel and arranged such that the first slot is stationary as the first base support is moved between the first sofa position and the first reclined position, wherein the first rear surface and the second rear surface comprise suede, wherein the first back support surface and the second back support surface comprise leather.

2. The seat assembly of claim 1, wherein, in the first compact position, the first back support surface faces a first seating support surface of the first base support.

3. The seat assembly of claim 2, wherein the first back support has a first orientation in the first sofa position and a second orientation in the compact position that is approximately 90 degrees from the first orientation.

4. The seat assembly of claim 1, wherein the first base support is configured to be stationary while the first back support is rotated between the first sofa position and the first compact position.

5. The seat assembly of claim 1, wherein the first slot is arranged to be inclined upwards as the first slot extends towards a front end of the seat assembly such that a front portion of the first base support is moved forward and tilted upwards when the first base support is moved to the first reclined position.

6. The seat assembly of claim 5, wherein the first seat includes a first leg rest, wherein the first leg rest is configured to move between a lowered position and a raised position.

7. The seat assembly of claim 1, wherein the third seat is positioned between the first seat and the second seat.

8. The seat assembly of claim 7, wherein the third back support is movable between a third sofa position and a third compact position.

9. The seat assembly of claim 7, wherein the third back support includes a back surface that defines a cup holder.

10. The seat assembly of claim 1, further comprising a first arm rest section having a first uppermost surface and a second art rest section having a second uppermost surface, wherein the first seat and the second seat are positioned between the first arm rest section and the second arm rest section, wherein the first art rest includes a power outlet.

11. The seat assembly of claim 10, wherein the first back support is completely positioned between the first uppermost surface and the first base support when in the first compact position.

12. An assembly comprising the seat assembly of claim 10 and a murphy bed assembly positioned adjacent to the seat assembly, wherein the murphy bed assembly includes a bed support movable between a stored position and an open position, wherein the bed support is configured to and able to extend directly between the first arm rest section and the second arm rest section and directly over the seat assembly in the open position when the first back support is in the first compact position and when the second back support is in the second compact position.

13. The assembly of claim 12, wherein, in the open position, the bed support includes a bottom surface that directly contacts the first rear surface and the second rear surface.

14. The seating assembly of claim 1, wherein the first frame mechanism includes a second slot and a second bearing arranged to move within the second slot as the first base support is moved between the first sofa position and the first reclined position, wherein the first frame mechanism is directly coupled to the first side panel and arranged such that the second slot is stationary as the first base support is moved between the first sofa position and the first reclined position.

15. The seating assembly of claim 1, wherein the first side panel comprises wood, wherein the first frame mechanism comprises metal.

16. The seating assembly of claim 1, wherein each of the first seat and the second seat includes two frame mechanisms comprising metal and directly coupled to a respective lower side panel comprising wood and a respective upper side panel comprising wood, wherein the first side panel is one of the respective lower side panels.

17. The seating assembly of claim 16, wherein the lower side panels are part of either the first base support or the second base support, wherein the upper side panels are part of either the first back support or the second back support.

18. A seat assembly comprising:

a first seat including a first internal frame section, a first back support, and a first base support, wherein the first back support and the first base support are movable between a first sofa position and a first reclined position, wherein the first back support is also movable between the first sofa position and a first compact position;

a second seat including a second internal frame section, a second back support, and a second base support, wherein the second back support and the second base support are movable between a second sofa position and a second reclined position, wherein the second back support is also movable between the second sofa position and a second compact position; and a third seat including a third internal frame section, a third back support, and a third base support, wherein the first back support, the second back support, and the third back support each have respective rear surfaces formed by a first fabric, wherein the first base support, the second base support, and the third base support each have respective back support surfaces formed by a second fabric, wherein the rear surfaces have a lower coefficient of friction compared to the back support surfaces.

19. The seat assembly of claim 18, wherein the first fabric comprises suede, wherein the second fabric comprises leather or synthetic leather.

* * * * *